United States Patent [19]

Schneider

[11] 4,055,261

[45] Oct. 25, 1977

[54] RE-STACKING DEVICE FOR STACKING PARTIAL STACKS OF SHEET MATERIAL TO FORM A COMPLETE STACK

[76] Inventor: Willi A. Schneider, Pfisterholzli 9, CH-8606 Greifensee, Zurich, Switzerland

[21] Appl. No.: 637,036

[22] Filed: Dec. 2, 1975

[30] Foreign Application Priority Data

Dec. 16, 1974 Switzerland ..... 16662/74

[51] Int. Cl.[2] ..... B65G 57/10

[52] U.S. Cl. ..... 214/6 G; 214/6 DK; 214/8.5 SS; 271/84

[58] Field of Search ..... 214/1 BB, 6 R, 6 G, 214/6 F, 6 DK, 8.5 SS; 271/84, 85, 189, 218

[56] References Cited

U.S. PATENT DOCUMENTS

| | | | |
|---|---|---|---|
| 3,017,041 | 1/1962 | Hawkes et al. | 214/6 G X |
| 3,405,932 | 10/1968 | Dame | 214/6 DK X |
| 3,516,653 | 6/1970 | Bland | 271/84 X |
| 3,747,920 | 7/1973 | Linkus | 271/85 |
| 3,833,132 | 9/1974 | Alduk | 214/6 G |
| 3,891,204 | 6/1975 | Mager | 271/85 |

*Primary Examiner*—L. J. Paperner
*Attorney, Agent, or Firm*—Burns, Doane, Swecker & Mathis

[57] ABSTRACT

A re-stacking device for stacking partial stacks of sheet material into a complete stack is disclosed. The device includes a slide mounted for raising and lowering on a machine support and carrying a table top which is horizontally movable back and forth between two end positions. A partial stack is placed on the table top in one of its end positions and moved with it to the other end position above a started stack supported on a stationary carrier. In this other end position the slide is lowered until the table top is a short distance above the top of the started stack. Hydraulically operated clamps are then moved toward the forward edge of the partial stack, and closed to grip this forward edge, whereupon the table top is horizontally withdrawn from under the partial stack so that the latter is deposited on the said started stack. Thereafter, the clamps are opened and withdrawn from the stack. The clamps are preferably mounted for horizontal movement on a second slide which can be raised and lowered on the machine support relative to the first mentioned slide.

9 Claims, 1 Drawing Figure

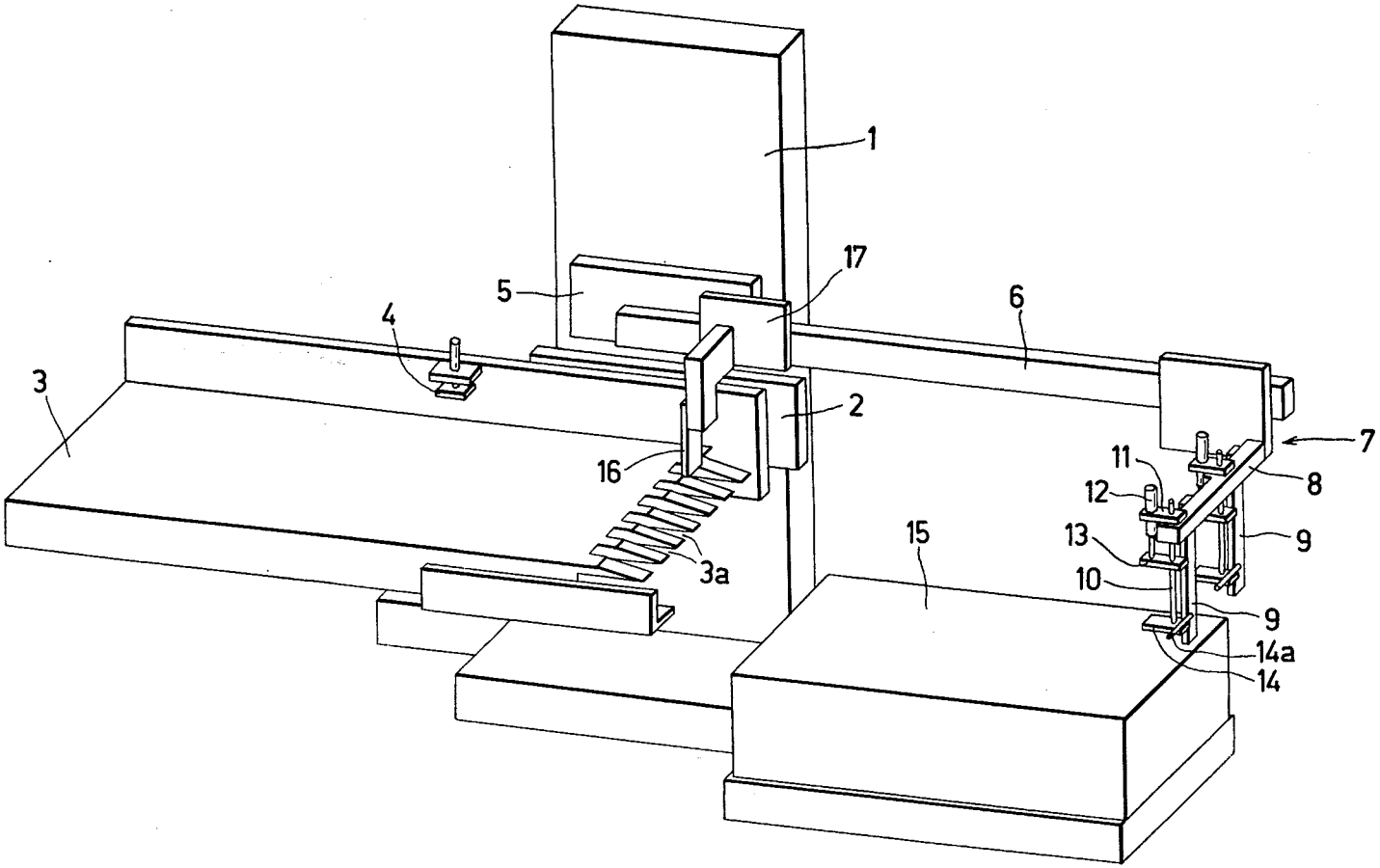
7
8
9
9
14a
14
11
12
13
10
6
15
1
17
2
3a
16
5
4
3

RE-STACKING DEVICE FOR STACKING PARTIAL STACKS OF SHEET MATERIAL TO FORM A COMPLETE STACK

BACKGROUND OF THE INVENTION

The invention relates to a re-stacking device for stacking partial stacks of sheet material into a complete stack, a table top being provided for receiving the partial stacks and supported on a slide so as to be horizontally movable back and forth between two end positions, which slide is adapted for raising and lowering on a machine support.

Devices of this type are known. They are used for example for piling up partial stacks of sheets of paper coming from a cutting machine. In operation, with the table top in one end position, a partial stack is deposited on same whereupon the table top is moved into its other end position above a carrier for receiving the partial stacks, e.g. a transporting pallet, and subsequently moved back again while depositing the partial stack (onto the carrier or onto previously stacked partial stacks). In order that the partial stack to be deposited is not also moved back with the returning table top, the known devices comprise a stop behind the partial stack which is lowered on to the table top before the latter is moved back and then prevents the partial stack being returned with the table top.

With the known devices it is as a rule impossible or only possible in an unsatisfactory way for the partial stacks to be piled up so as to be fully and reliably in precise alignment, particularly when the sheet material has very smooth surfaces.

The aim of the invention is to overcome this disadvantage.

SUMMARY OF THE INVENTION

The re-stacking device according to the invention and of the type described at the beginning of the specification is characterized in that at the point where an edge of the table top is in one end position, there is arranged a clamping unit comprising at least one gripping means with clamping jaws adapted for raising and lowering relative to the table top as well as for horizontal forward and return movement relative to the machine support, for clamping an edge of a partial stack on the said edge of the table top.

The clamping unit is preferably horizontally slidably supported on a second slide which can be raised and lowered relative to the first mentioned slide, e.g. by means of a hydraulic cylinder provided between the two slides.

BRIEF DESCRIPTION OF THE DRAWING

A preferred embodiment of the stacking device according to the invention is diagrammatically illustrated in perspective in the drawing.

DESCRIPTION OF PREFERRED EMBODIMENT

The illustrated stacking device comprises a machine support 1 standing on the floor, on which there is arranged a slide 2 adapted for vertical upward and downward movement by driving means (not shown). The slide 2 supports a horizontally slidable table top 3, preferably a so-called "air table" with air outlets for forming an air cushion on which a partial stack of sheets can be easily moved. The driving means for the reciprocating movement of the table between two end positions are likewise not shown. Attached to a rear flange of the table top is a clamping plate 4 which can be actuated by a hydraulic cylinder to firmly clamp a partial stack on the table.

In addition, a second slide 5 is vertically slidably guided on the support 1 and can be raised and lowered relative to the first slide 2 by a hydraulic cylinder (not shown). The slide 5 carries a guide rail 6 extending to the right side on which there is arranged a horizontally slidable clamping unit 7.

The clamping unit 7 comprises a horizontal frame element 8 perpendicular to the guide rail 6, with two vertically downwardly projecting stop bars 9 for the partial stacks of paper sheets to be stacked up being fixed to the said frame element 8. The frame element 8 also supports two grippers for firmly clamping an edge of a partial stack after the latter has been moved forward as far as the stop bars 9. Each gripper comprises a rod 10 which is vertically slidably guided in the frame element 8. Attached to the upper end of the rod 10, above the frame element 8, is a block 11 supporting a hydraulic cylinder 12 by means of which an upper clamping jaw 13 can be moved along the rod 10. A lower clamping jaw 14 is attached to the lower end of the rod 10. The grippers must naturally be secured to prevent rotation about vertical axes. In order to achieve this, the single rod 10 which is illustrated to improve clarity can be advantageously replaced by two parallel round bars in each gripper.

The operation of the illustrated stacking device will now be described.

Between the clamping unit 7 and the right end of the table top 3, which is in its left end position in the drawing, there is shown standing on a transport pallet on the floor the beginning of a stack 15 of sheets of paper on top of which further partial stacks are to be deposited.

The table top 3 is at a predetermined working height at which a partial stack of paper sheets coming e.g. from a cutting machine can be moved on to the table. This partial stack is manually pressed against the rear flange of the table top 3 and against a stop 16 which is located above the front or right-hand end of the table. The stop 16 is attached to a carrier 17 which is horizontally slidably mounted on the guide rail 6.

The machine is then switched on, and the subsequent steps are performed by an automatic control arrangement (sequence control).

The clamping plate 4 is first lowered by its hydraulic cylinder so as to clamp the deposited partial stack of sheets firmly on the table top 3. The supply of air to the "air table" is interrupted.

Then a photoelectric cell (not shown) connected to the slide 2 determines whether the underside of the table top is at a higher level than the upper side of the beginning of the stack 15 of sheet material. If this is not the case, the table 3 is correspondingly raised by the slide 2.

The stop 16 is then drawn away to the right by sliding the plate 17 along the guide rail 6 by means of a hydraulic cylinder (not shown) by a predetermined distance laterally of the partial stack on the table top, and then the slide 5, together with the plate 17 (and stop 16) and the clamping unit 7, is raised relative to the slide 2 by a predetermined distance by a hydraulic cylinder (again not shown).

The table feed is then switched on and the table top 3 displaced with the partial stack of paper sheets horizontally from its illustrated left end position into its right end position. The slide 2 is then lowered down the support 1 until the underside of the table is just above the upper side of the beginning of the stack 15 of sheet material, which movement is determined by a photoelectric cell. (The slide 5 also takes part in this movement of the slide 2). After the height of the slide 2 is sèt, the slide 5 is lowered again on to the slide 2. In this connection the lower jaws 14 move into slits 3*a* in the tapering thickness of the right edge of the table top 3 until horizontal stop rods 14*a*, fixed on the jaws 14, are supported by their ends on the projections of the table top between the slits 3*a*. Upon further lowering of the slide 5 and therefore frame element 8, the grippers 10–14 stop moving downward since the bars 10 are freely slidable in the frame element 8. The grippers 10–14 are supported by their own weight on the table projections between the slits 3*a*. The entire clamping unit 7 is then moved along the rail 6 from its right to its left end position by another hydraulic cylinder (not shown), the lower jaws 14 sliding obliquely upwardly over the table projections and under the right edge of the partial stack of sheets on the table top.

After the unit 7 has reached its left end position and the stop bars 9 engage on the right side of the beginning of the stack 15 on the floor, the upper jaws 13 are pressed downwardly by the hydraulic cylinders 12 in order to clamp firmly the right edge of the partial stack on the table top with a predetermined force. Since the cylinders 12 are arranged on the left side of the rods 10, facing the table top 3, the lower ends of the rods can be flexibly bent slightly to the right, away from the table top, by this predetermined force in order to, if necessary, move the clamped partial stack precisely into contact with the stop bars 9.

The table top 3 is then moved back to the left (after switching on the supply of compressed air to the air table and raising the clamping plate 4) and therefore moved away under the partial stack which is deposited in perfect alignment on the original stack 15.

Finally the grippers are re-opened by the hydraulic cylinders 12 and then the clamping unit 7 is moved back along the rail 6 into its right end position whereupon the device is back in the starting position after the slide 2 and table top 3 are set at the working height.

The joint raising and lowering of the stop 16 and clamping unit 7 by means of the second slide 5, which can only be raised and lowered relative to the first slide 2 by a predetermined distance, e.g. about 20 cm, provides a particularly simple constructional solution. However, alternative means could obviously be provided for raising and lowering either the entire clamping unit or at least the grippers 10–14.

Depending on the width of the partial stack of sheet material to be handled, the two grippers 10–14 as well as the stop bars 9 can be fitted at different points along the frame element 8 (in alignment with each of the slits 3*a*). Naturally in certain cases only one of the grippers 10–14 may be sufficient to clamp a partial stack or in other cases more than two grippers could be provided on the frame element 8.

What I claim is:

1. A re-stacking device for stacking partial stacks of sheet material into a complete stack, including a machine support, a slide adapted for raising and lowering on said machine support, a table top for receiving said partial stacks supported on said slide so as to be horizontally movable back and forth between two end positions, and a clamping unit arranged at the point where an edge of said table top is in one of said end positions, said clamping unit comprising at least one gripper with upper and lower clamping jaws having horizontally extending clamping surfaces, at least one slit being provided in the said edge of said table top for receiving said lower clamping jaw, said upper and lower clamping jaws being mounted so as to move vertically in unison and said upper clamping jaw being adapted for vertically raising and lowering relative to said lower jaw, for clamping an edge of a partial stack on the said edge of said table top without relative horizontal displacement between said table top and said partial stack before the latter is clamped between said clamping jaws.

2. A re-stacking device as claimed in claim 1 and further comprising a clamping plate mounted on said table top and which can be raised and lowered for firmly clamping a partial stack on the table top.

3. A re-stacking device as claimed in claim 1 and further comprising a second slide which can be raised and lowered relative to said first mentioned slide and on which said clamping unit is horizontally slidably mounted.

4. A re-stacking device as claimed in claim 3, wherein said clamping unit comprises a frame element on which said clamping jaws are mounted for raising and lowering.

5. A re-stacking device for stacking partial stacks of sheet material into a complete stack, including a machine support, a first slide adapted for raising and lowering on said machine support, a table top for receiving said partial stacks supported on said first slide so as to be horizontally movable back and forth between two end positions, a second slide which can be raised and lowered relative to said first slide, a stop for an edge of a partial stack on said table top which stop is horizontally slidably mounted on said second slide, and a clamping unit horizontally slidably mounted on said second slide and arranged at the point where an edge of said table top is in one of said end positions, said clamping unit comprising at least one gripper with clamping jaws adapted for raising and lowering relative to said table top as well as for horizontal forward and return movement relative to said machine support, for clamping an edge of a partial stack on the said edge of said table top.

6. A re-stacking device for stacking partial stacks of sheet material into a complete stack, including a machine support, a first slide adapted for raising and lowering on said machine support, a table top for receiving said partial stacks supported on said slide so as to be horizontally movable back and forth between two end positions, a second slide which can be raised and lowered relative to said first slide, and a clamping unit horizontally slidably mounted on said second slide and arranged at the point where an edge of said table top is in one of said end positions, said clamping unit comprising a frame element which can be raised and lowered and horizontally displaced relative to said slide, and at least one gripper including a lower jaw mounted on said frame element and freely and vertically slidably guided relative to said frame element, a vertically slidable upper jaw mounted on said frame element, the upper and lower jaws adapted for raising and lowering relative to said table top as well as horizontal forward and return movement relative to said machine support and a driving means for vertically moving said upper jaw relative to said lower jaw for clamping an edge of a partial stack on the said edge of said table top.

7. A re-stacking device as claimed in claim 6, wherein said driving means is arranged between said two clamping jaws in such manner that upon exertion of the clamping force, said jaws tend to move horizontally away from said table top upon flexible deformation of guide elements.

8. A re-stacking device as claimed in claim 6 and further comprising at least one slit in the said edge of said table top for receiving said lower jaw of said gripper.

9. A re-stacking device as claimed in claim 8 and further comprising a laterally projecting element carried on said lower jaw for resting on said table top next to said slit.

* * * * *